US008075164B2

(12) United States Patent
Xiao et al.

(10) Patent No.: US 8,075,164 B2
(45) Date of Patent: Dec. 13, 2011

(54) LED LAMP

(75) Inventors: Xin-Jian Xiao, Shenzhen (CN); Qin-Fei Zhou, Shenzhen (CN); Shih-Hsun Wung, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 148 days.

(21) Appl. No.: 12/508,517

(22) Filed: Jul. 23, 2009

(65) Prior Publication Data

US 2010/0157610 A1 Jun. 24, 2010

(30) Foreign Application Priority Data

Dec. 22, 2008 (CN) ..... 2008 1 0306429

(51) Int. Cl.
*F21V 29/00* (2006.01)

(52) U.S. Cl. ..... 362/294; 362/373

(58) Field of Classification Search ..... 362/294, 362/373, 249.02, 221
See application file for complete search history.

(56) References Cited

U.S. PATENT DOCUMENTS

| | | | | |
|---|---|---|---|---|
| 7,637,638 | B2 * | 12/2009 | Chen | 362/294 |
| 7,654,703 | B2 * | 2/2010 | Kan et al. | 362/362 |
| 7,810,955 | B2 * | 10/2010 | Stimac et al. | 362/294 |
| 7,918,591 | B2 * | 4/2011 | Lynch | 362/365 |
| 7,976,188 | B2 * | 7/2011 | Peng | 362/249.02 |
| 2008/0089071 | A1 * | 4/2008 | Wang | 362/294 |
| 2010/0027269 | A1 * | 2/2010 | Lo et al. | 362/294 |
| 2010/0309662 | A1 * | 12/2010 | Zheng | 362/235 |

* cited by examiner

*Primary Examiner* — Peggy A. Neils
(74) *Attorney, Agent, or Firm* — Altis Law Group, Inc.

(57) ABSTRACT

An LED lamp includes a housing, an LED module, a fixing bracket and a power driver source. The housing includes a base plate and first and second sidewalls extending downwardly from two opposite edges of the base plate, respectively. A light emitting window is defined between free, bottom ends of the first and the second sidewalls and located under the base plate. The base plate has a heat absorbing surface facing the light emitting window and a heat dissipating surface opposite to the heat absorbing surface. A plurality of fins are provided on the heat dissipating surface of the base plate. The LED module, which is received in the housing and mounted on the heat absorbing surface of the base plate, faces the light emitting window. The fixing bracket is mounted on the housing and located above the base plate of the housing.

4 Claims, 4 Drawing Sheets

LED LAMP

BACKGROUND

1. Technical Field

The disclosure relates to an LED (light-emitting diode) lamp, and more particularly to an improved LED lamp with a high heat dissipating efficiency.

2. Description of Related Art

An LED lamp utilizes LEDs as a source of illumination, in which current flowing in one direction through a junction region comprising two different semiconductors results in electrons and holes coupling at the junction region and generating a light beam. The LED is resistant to shock and has an almost endless lifetime under specific conditions, making it a popular, cost-effective and high quality replacement for incandescent and fluorescent lamps.

Known implementations of LED modules in an LED lamp make use of a plurality of individual LEDs to generate light that is ample and of satisfactory spatial distribution. Therefore, heat dissipation of the LED lamp is a problem inhibiting the application of the LED lamp, which requires to be resolved. For a high brightness LED lamp, a highly efficient heat dissipation device is necessary in order to timely and adequately remove the heat generated by the LED lamp. Otherwise, the brightness, lifespan, and reliability of the LED lamp will be seriously affected.

What is needed, therefore, is an LED lamp which can overcome the limitations described.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Figure 1:
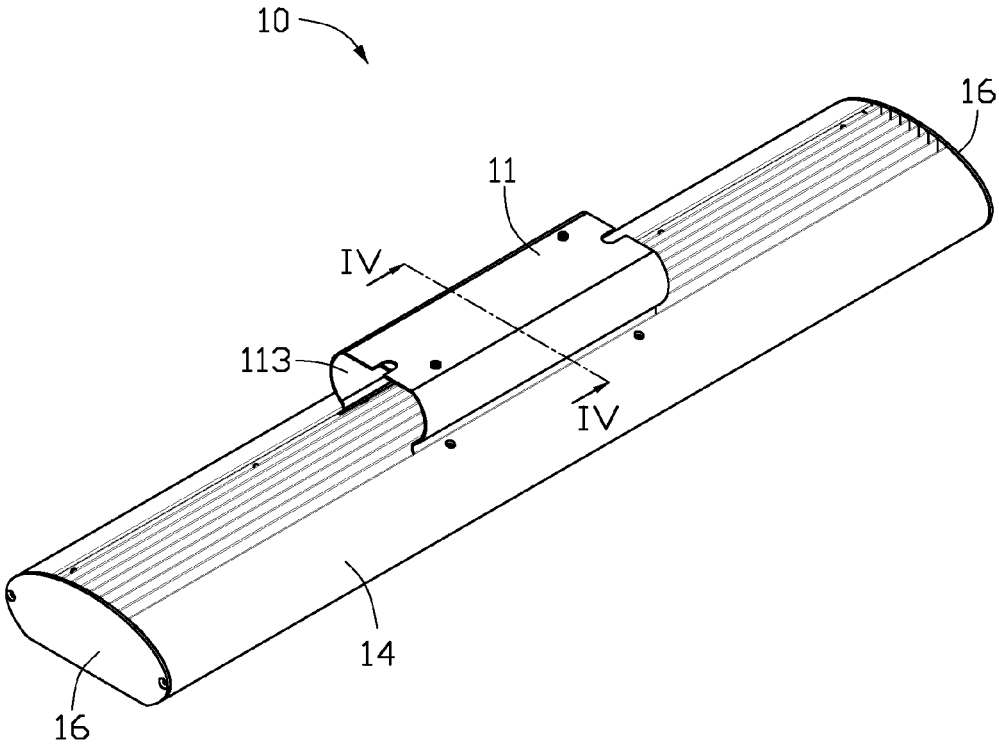
FIG. 1 is an isometric, assembled view of an LED lamp in accordance with an exemplary embodiment of the disclosure.

Referring to FIG. 1, an LED lamp 10 in accordance with an exemplary embodiment is illustrated. The LED lamp 10 includes a housing 14 at a bottom side of the LED lamp 10, an LED module 15 (FIG. 3) disposed in the housing 14, and a fixing bracket 11 mounted on the housing 14.

Figure 2:
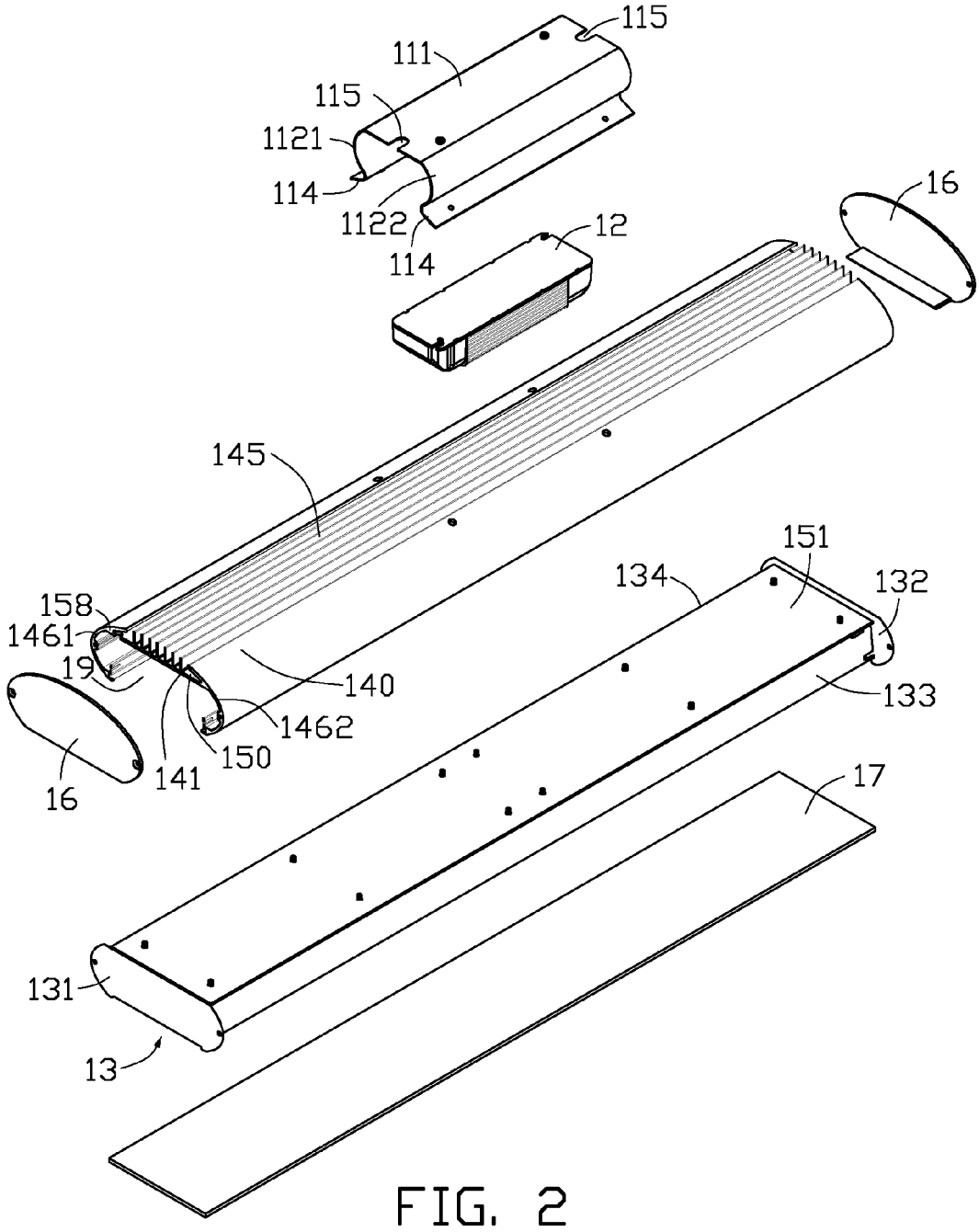
FIG. 2 is an exploded view of the LED lamp of FIG. 1.
Figure 3:
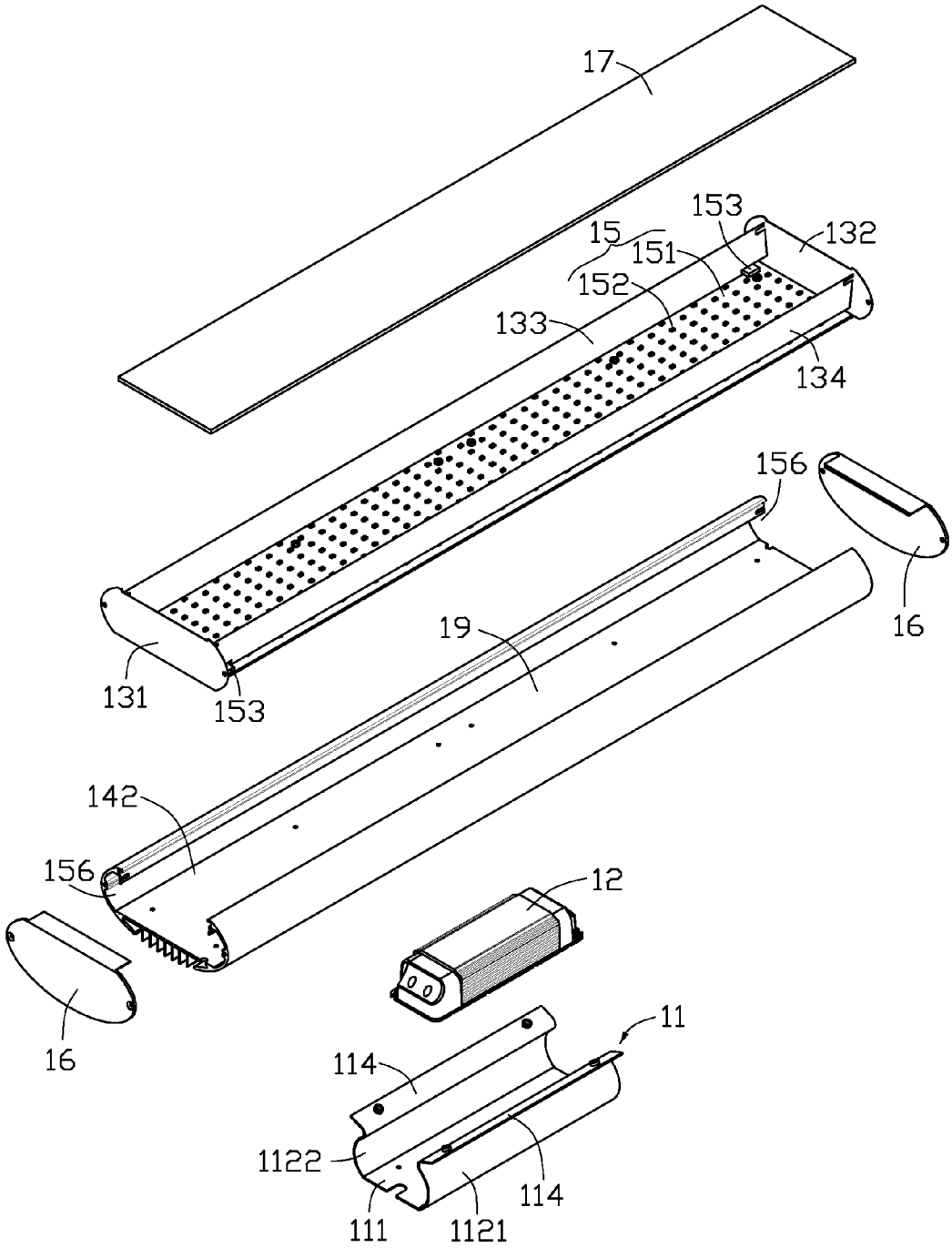
FIG. 3 is an exploded view of the LED lamp of FIG. 1, viewed from another aspect.

Referring to FIGS. 2-3, the housing 14 is made of a high heat conductive material, such as aluminum or aluminum alloy, and integrally formed as a single piece by extrusion. The housing 14 includes an elongate base plate 141, a first sidewall 1461, a second sidewall 1462 and two opposite connecting plates 140.

The base plate 141 includes an inner heat absorbing surface 142 at a bottom side of the base plate 141 and an outer heat dissipating surface 143 opposite to the heat absorbing surface 142. The first sidewall 1461 and the second sidewall 1462 extend downwardly from two lateral edges 158 of the base plate 141, respectively. Each of the first sidewall 1461 and the second sidewall 1462 extends outwardly and downwardly from the corresponding lateral edge 158 of the base plate 141, and then inwardly and downwardly towards the other one of the first sidewall 1461 and the second sidewall 1462. The first sidewall 1461 is C-shaped, and the second sidewall 1462 is an inverted C-shape, with an open side of the second sidewall 1462 facing an open side of the first sidewall 1461. Free bottom ends 147 of the first sidewall 1461 and the second sidewall 1462 are opposite to and spaced from each other to cooperatively define a light emitting window 19 therebetween. The two free bottom ends 147 each are bifurcated into a top edge 155 and a bottom edge 157. The top edge 155 and the bottom edge 157 of each free end 147 cooperatively define a first latching groove 148 therebetween.

A resilient tab 154 extends upwardly from a free end of the top edge 155. An elongate optical lens 17 is disposed between the two free ends 147 of the first sidewall 1461 and the second sidewall 1462. Two opposite lateral edges of the optical lens 17 are received in the two first latching grooves 148, respectively. The base plate 141, the first sidewall 1461, the second sidewall 1462 and the optical lens 17 cooperatively define a hollow space with two opposite openings 156 at two longitudinal ends of the hollow space, respectively.

The two connecting plates 140 extend upwardly and inwardly from the two lateral edges 158 of the base plate 141, respectively. Each of the two connecting plates 140 and the heat absorbing surface 142 cooperatively define a second latching groove 150 therebetween. The housing 14 forms a plurality of fins 145 between the two connecting plates 140, wherein the fins 145 extend upwardly from the heat dissipating surface 143. An airflow channel is defined between every two adjacent fins 145.

The LED module 15 includes an elongate printed circuit board 151 mounted on the heat absorbing surface 142 of the base plate 141 and a plurality of LED components 152. The plurality of LED components 152 are mounted on the printed circuit board 151 and spaced from each other. Two electrodes 153 are formed on and located at two diagonal corners of the printed circuit board 151.

A reflector 13 is connected between the optical lens 17 and the printed circuit board 151. The reflector 13 extends inwardly and upwardly from an outer peripheral edge of the optical lens 17 towards the printed circuit board 151. The reflector 13 surrounds the LED components 152 and includes a left reflector board 133, a right reflector board 134, a front reflector board 131 and a rear reflector board 132. The left reflector board 133 and the right reflector board 134 are disposed at the two lateral edges 158 of the base plate 141, respectively. The front reflector board 131 and the rear reflector board 132 are disposed at two transverse edges of the base plate 141, respectively. Bottom ends of the left reflector board 133 and the right reflector board 134 are attached to the two resilient tabs 154 of the housing 14, respectively.

Two end covers 16 are connected to the two longitudinal ends of the housing 14 by screws (not shown) and cover the two openings 156, respectively. The front reflector board 131 and the rear reflector board 132 are attached to the two end covers 16, respectively. The housing 14, the optical lens 17 and two end covers 16 cooperatively define a space for receiving the LED module 15 therein.

Figure 4:
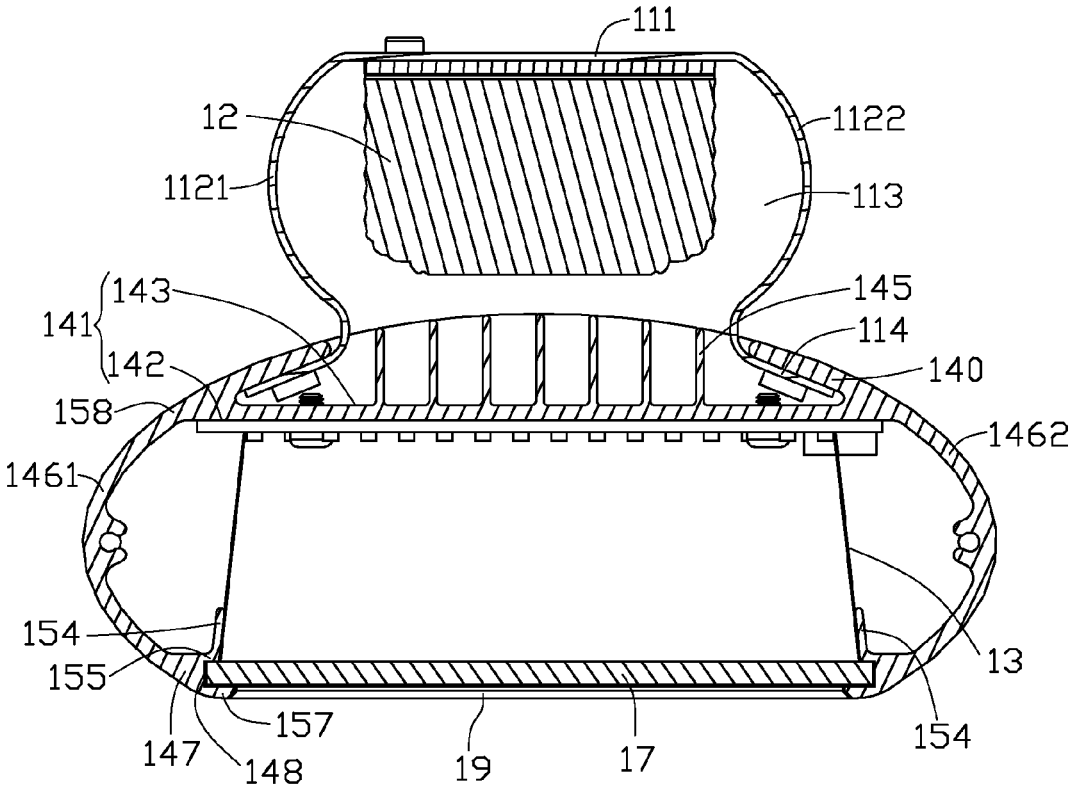
FIG. 4 is a cross-sectional view of the LED lamp of FIG. 1, taken along line IV-IV thereof.

Referring to FIG. 4, the fixing bracket 11 includes an elongate mounting plate 111 at a top side of the fixing bracket 11, a first connecting wall 1121, a second connecting wall 1122 and two securing portions 114 at a bottom side of the fixing bracket 11.

The mounting plate 111 defines two mounting holes 115 therein. The first connecting wall 1121 and the second connecting wall 1122 extend downwardly from two lateral edges of the mounting plate 111, respectively. The first connecting wall 1121 is C-shaped, and the second connecting wall 1122 is inverted C-shape, with an opening of the second connecting wall 1122 facing an opening of the first connecting wall 1121.

The two securing portions 114 each extend downwardly and outwardly from a bottom end of the first connecting wall 1121 and the second connecting wall 1122, respectively. The two securing portions 114 are respectively engaged in the two second latching grooves 150, and respectively connected to the two connecting plates 140 by screws (not shown).

The fixing bracket 11 has a longitudinal length shorter than that of the base plate 141 of the housing 14. The fixing bracket 11 and the base plate 141 cooperatively define a receiving space 113 therebetween with two openings at two opposite longitudinal ends of the receiving space 113. A power driver source 12 is located in the receiving space 113 and mounted to the mounting plate 111 of the fixing bracket 11. The power driver source 12 spaces a distance from top ends of the fins 145. The power driver source 12 is electrically connected with the electrodes 153 of the printed circuit board 151 for supplying power to the LED components 152.

In use, the housing 14 serves as a protecting enclosure for protecting the LED module 15, and also functions as a heat dissipating device for dissipating heat generated by the LED module 15 wherein the heat of the LED module 15 can be effectively dissipated by the fins 145 formed on the base plate 141 of the housing 14. Moreover, the power driver source 12 is isolated spatially from the LED module 15, which can prolong lifespan of the power driver source 12.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp comprising:

a housing made of a heat conductive material, the housing comprising an elongate base plate and first and second sidewalls extending downwardly from two opposite edges of the base plate, respectively, a light emitting window being defined between free ends of the first and the second sidewalls and located under the base plate, the base plate having a heat absorbing surface facing the light emitting window and a heat dissipating surface opposite to the heat absorbing surface;

an LED module received in the housing and comprising a printed circuit board mounted on the heat absorbing surface of the base plate and a plurality of LED components mounted on the printed circuit board, the LED components facing the light emitting window;

a fixing bracket mounted on the housing and facing the heat dissipating surface of the base plate, the fixing bracket having a longitudinal length shorter than that of the base plate of the housing, the fixing bracket and the base plate of the housing cooperatively defining a receiving space with two openings at two opposite longitudinal ends of the receiving space;

a power driver source being provided for supplying electrical power for the LED components, the power driver source being mounted to the fixing bracket and received in the receiving space; and an optical lens being disposed at the light emitting window;

wherein a plurality of fins are formed on the heat dissipating surface of the base plate, an airflow channel being defined between every two adjacent fins;

wherein the first sidewall has a C-shape, and the second sidewall has an inverted C-shape, an open side of the first sidewall facing an open side of the second sidewall;

wherein the free end of the first sidewall and the free end of the second sidewall each define a first latching groove, and two lateral edges of the optical lens are received in the two first latching grooves, respectively; and wherein two opposite lateral sides of the fixing bracket each form a securing portion, the housing further comprising two connecting plates corresponding to the two securing portions, each of the two connecting plates extending inwardly and upwardly from one of the two opposite edges of the base plate, each of the two connecting plates and the base plate of the housing cooperatively defining a second latching groove, each of the two securing portions being engaged in a corresponding second latching groove.

2. The LED lamp as claimed in claim 1 further comprising two end covers, the optical lens and the housing cooperatively defining a hollow space with two openings at two opposite longitudinal ends of the hollow space, the two end covers being disposed at the two longitudinal ends of the housing and covering the two openings, respectively.

3. The LED lamp as claimed in claim 1 further comprising a reflector, the reflector being disposed between the printed circuit board and the optical lens, the reflector surrounding the LED components, the reflector extending inwardly and upwardly from the optical lens towards the printed circuit board.

4. The LED lamp as claimed in claim 1, wherein the printed circuit board forms two electrodes thereon, the two electrodes being located at two diagonal corners of the printed circuit board.

* * * * *